US008464761B2

(12) United States Patent
Young et al.

(10) Patent No.: US 8,464,761 B2
(45) Date of Patent: Jun. 18, 2013

(54) FLOW CONTROL ARRANGEMENT

(75) Inventors: Colin Young, Derby (GB); Paul Wilson, Long Eaton (GB); Lou Peng, Derby (GB)

(73) Assignee: Rolls-Royce PLC, London (GB)

( * ) Notice: Subject to any disclaimer, the term of this patent is extended or adjusted under 35 U.S.C. 154(b) by 828 days.

(21) Appl. No.: 12/458,829

(22) Filed: Jul. 23, 2009

(65) Prior Publication Data

US 2010/0028145 A1 Feb. 4, 2010

(30) Foreign Application Priority Data

Aug. 4, 2008 (GB) ..... 0814111.1

(51) Int. Cl.
*F15D 1/04* (2006.01)

(52) U.S. Cl.
USPC ..... 138/37; 138/39; 138/44; 110/260

(58) Field of Classification Search
USPC ..... 138/37, 39, 44, 45; 110/260–265
See application file for complete search history.

(56) References Cited

U.S. PATENT DOCUMENTS

| | | | | | |
|---|---|---|---|---|---|
| 530,298 | A | * | 12/1894 | Burrell | 426/317 |
| 535,642 | A | * | 3/1895 | Thomson | 73/202 |
| 1,120,129 | A | * | 12/1914 | Cable | 261/116 |
| 1,776,741 | A | * | 9/1930 | Schwab | 138/44 |
| 1,892,906 | A | * | 1/1933 | Schnitter | 138/44 |
| 2,914,915 | A | * | 12/1959 | Sziklas et al. | 138/44 |
| 3,111,091 | A | * | 11/1963 | Hopkinson | 417/186 |
| 3,881,653 | A | | 5/1975 | Birckhead | |
| 4,452,277 | A | * | 6/1984 | Wells | 138/44 |
| 4,934,284 | A | * | 6/1990 | Nitz et al. | 110/263 |
| 5,088,528 | A | * | 2/1992 | Grantham | 141/44 |
| 5,483,906 | A | * | 1/1996 | Hufton | 110/260 |
| 5,979,507 | A | | 11/1999 | Kojima et al. | |
| 8,317,885 | B2 | * | 11/2012 | Van Den Berg et al. | 48/69 |

FOREIGN PATENT DOCUMENTS

| | | |
|---|---|---|
| GB | 2 272 755 A | 5/1994 |
| GB | 2 397 635 A | 7/2004 |

* cited by examiner

*Primary Examiner* — Patrick F Brinson
(74) *Attorney, Agent, or Firm* — Oliff & Berridge, PLC

(57) ABSTRACT

Flow restrictors (4), (14) are widely utilized with regard to providing flow control in such situations as with respect to sealing and pressurization of bearing chambers in gas turbine engines. The restrictor (4), (14) restricts a flow (5), (15) but with prior arrangements may be susceptible to deposition upon flank surfaces of the restrictor (4). These depositions may fragment and block an aperture (7), (17) of the restrictor (4), (14) reducing operational effectiveness. By provision of a deflector (18) having a deflector surface (19) flows (15) can be presented such that a greater proportion of the flow including droplets or other matter which may result in surface deposition or erosion will pass directly through an aperture (7, 17) rather than impinge upon the flank surfaces of the restrictor (14). Furthermore, the deflector (18) is dimensioned such that surfaces which may be susceptible to deposition have dimensions smaller than the aperture (17).

16 Claims, 4 Drawing Sheets

FLOW CONTROL ARRANGEMENT

BACKGROUND

The present invention relates to flow control arrangements and more particularly to a flow control arrangement utilised within a flow path where depositions may reduce or through-flow or choke a restriction.

Flow control arrangements are provided in which there is a flow restriction—such as an orifice—in a flow path. For example, in order to prevent oil egress from bearing chambers between rotating and static features, it is common practice to provide high pressure sealing air around the periphery of the bearing chamber. The high pressure air then enters the bearing chamber through seals preventing and/or limiting the escape of oil from the sealed mechanism. Once the air flow has passed through the bearing chamber seals and the bearing chamber itself it is understood that the air is taken from that bearing chamber to a low pressure sink. The clearance between the rotating and static seal members is typically specified in order to accommodate the relative movements of the rotor and stator during operation, rather than to control the sealing air flow rate. In such circumstances a flow control function is achieved through utilising a high resistance fitting—typically in the form of an orifice within the vent line connecting the bearing chamber to the low pressure sink.

In order to develop the necessary flow control resistance generally the flow, as indicated, is restricted by an orifice which essentially chokes the flow through a relatively small diameter or cross sectional area for the restrictor. Possibly a restrictor may be in the order of half a millimeter but it is understood that this is dependent upon a particular operational requirements.

FIG. 1 provides a schematic illustration of a typical prior flow control arrangement (1). As can be seen a flow path (2) extends along a flow or vent axis (3) with a flow constriction (4) positioned to extend across the flow path (2) between an upstream side (2*a*) and a downstream side (2*b*). Such flow control through the flow restriction may be acceptable where there is pure or uncontaminated air flow but unfortunately flows in accordance with a large number of applications and in particular with regard to seals in a gas turbine engine will generally compromise a mixture of oil droplets carried within the flow in the direction of arrowhead (5). It will also be understood that the flow path (2) may be routed through areas of high temperature or other environmental conditions such that there can be variations in the air to oil mixture composition resulting in localised overheating and/or degradation of the oil droplets with the result that laquering and carbon deposition (6) can occur upon the surfaces of the orifices (4). This carbonisation and laquer deposition can build up over time to a significant thicknesses. The deposits again through potentially thermal cycling and other physical actions including vibration may break up and so form flakes which can then be transported downstream in the flow (5).

FIG. 2 illustrates a potential situation with regard to laquer or deposition break up for the arrangement (1). Thus, as previously explained an air flow which is contaminated with oil droplets passes in the direction of arrowhead (5) within an upstream section (2*a*) of a flow path. The flow (5) engages a flow restrictor (4) and as previously a deposition has occurred from the oil droplets within the flow (5). As depicted in FIG. 2 a part (6*a*) of the deposition has become detached. This detached deposition part (6*a*) may cause a partial or possibly as depicted in FIG. 2 a total blockage of a vent aperture (7) of the restrictor (4). Thus, there will be reduced or no flow through the vent line.

It will be understood that blockage of the flow path will result in cessation of the necessary sealing flows and therefore failure of the sealing mechanism as described above. Similar problems may occur with regard to the functionality achieved by flows with other mechanical arrangements. With regard to a bearing seal, it is understood without the air flow pressurisation there will be leakage of oil from the bearing chamber which may result in potential problems with regard to oil firing, odour and leakage to an external environment as well as degradation of the actual bearing function itself through lack of lubricant. In any event, it will be necessary to clear the aperture (7) by an appropriate remedial action and thus there will be expensive unscheduled maintenance and repair down time for a machine such as a gas turbine engine.

SUMMARY

In accordance with aspects of the present invention there is provided a flow control arrangement comprising a flow path with a flow restrictor in the flow path of reduced area to the flow path, the arrangement is characterised in that a deflector is provided upstream of the restrictor in the flow path at a displaced position to urge a flow in use away from the flow path towards the restrictor.

Generally, a deflector is defined by an orifice.

Typically, the deflector has a deflector surface at a deflection angle towards a position upstream of the orifice. Typically, the position is along a vent axis central to the flow path and/or the orifice. Typically, the deflection angle is dependent upon an expected flow rate for the flow in use. Possibly, the deflection angle can be adjusted.

Typically, the deflection surface has a width sufficient to deflect the flow in use. Generally, the deflection surface is smooth. Alternatively, the deflection surface is undulated or grooved. Generally, the deflection surface includes a sacrificial deposition area for deposits taken from the flow. Generally the deposition area is arranged to limit deposition particle sizes upon fragmentation from the deposition area. Generally the deposition area has a width less than the orifice size. Possibly, the deflection surface includes a coating to inhibit deposition.

Possibly, the deflector is variably deployable into the flow path.

Generally, the flow in use is air with entrained droplets or particles.

Possibly, the flow in use is air with entrained particulate matter, where deposition and build is possible.

Additionally, the flow deflection feature is hardened or otherwise treated to sacrificially resist erosion Also in accordance with aspects of the present invention, there is provided a gas turbine engine incorporating a flow control arrangement as described above.

EMBODIMENTS

An embodiment of aspects of the present invention will now be described by way of example only with reference to the accompanying drawing FIG. 3 which schematically illustrates a flow control arrangement in accordance with aspects of the present invention As indicated above utilisation of orifices or apertures which extend inwardly across a flow path are known. The surfaces which form the orifice or aperture may be subject to laquer build up and should that laquer or deposit build up break away and fragment it is possible for the orifice or aperture to be blocked at least partially.

Figure 1:
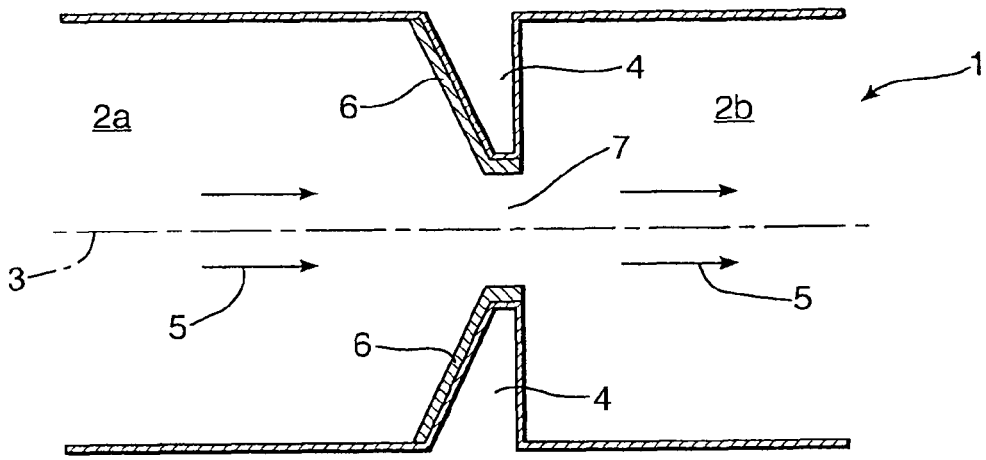
FIG. 1 provides a schematic illustration of a typical prior flow control arrangement.
Figure 2:
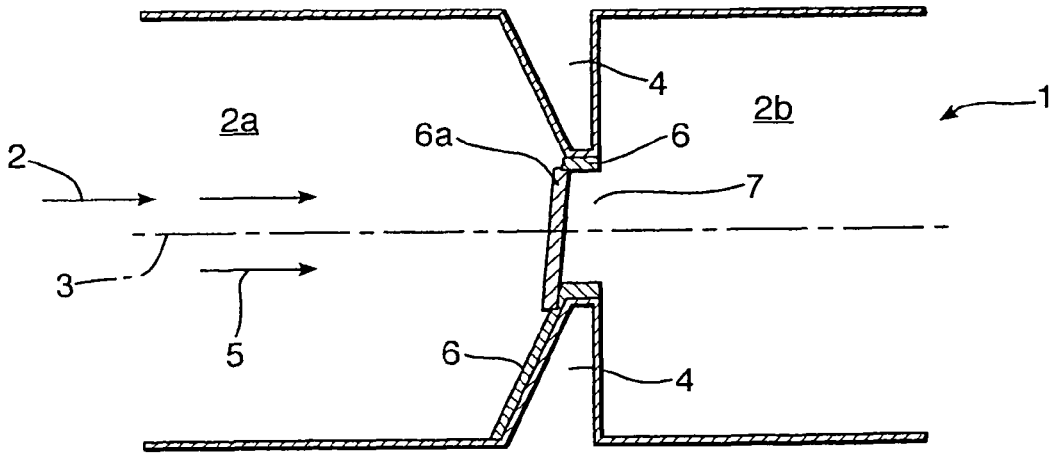
FIG. 2 illustrates a potential situation with regard to laquer or deposition break up for the arrangement in FIG. 1.
Figure 3:
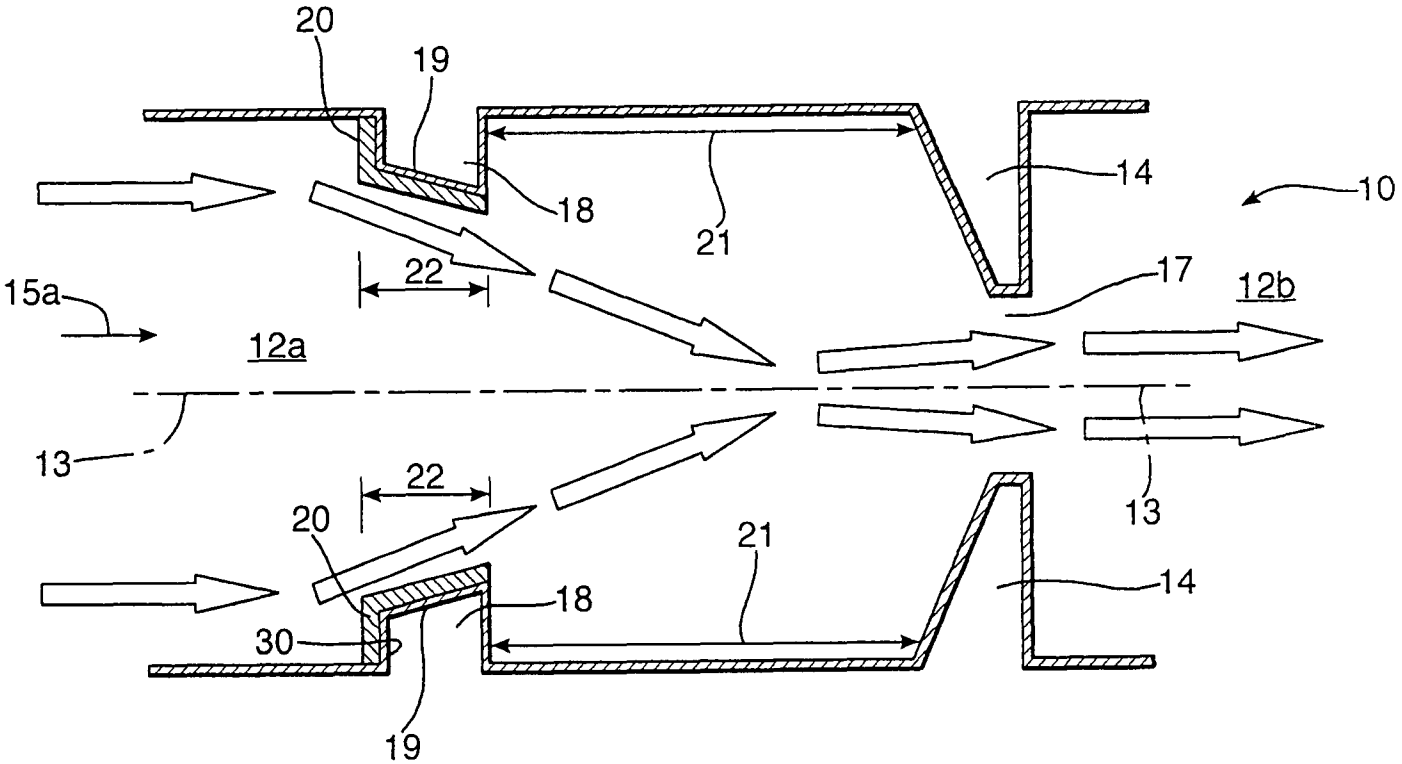
FIG. 3 illustrates a flow control arrangement in accordance with embodiments.

Referring to FIG. 3 illustrating a flow control arrangement (10) in accordance with aspects of the present invention. As can be seen a conventional high resistance restrictor (14) is provided in order to define an orifice or aperture (17) which extends across a flow path (12) between an upstream portion (12*a*) and a downstream portion (12*b*). In such circumstances control of a flow (15) through the flow path (12) is maintained. However, in accordance with aspects of the present invention a deflector (18) is provided upstream of the restrictor (14) in order to modify the flow (15) and generally deflect or guide that flow towards a position upon axis (13) generally running centrally along the path (12). As will be described later the deflector (18) can take a number of forms.

The deflector (18) in principle acts to deflect the flow (15) by engagement across a deflector surface (19) towards the orifice or aperture (17). By such deflection it is understood that the possibility of deposition of oil particles etc is limited by straight through transfer of the flow through the aperture (17). It is understood that the less of the flow (15) which contacts surfaces of the restrictor (14) the less likelihood of deposition.

The deflector (18) also provides deposition surfaces which are sacrificial. In such circumstances, the leading dimensions typically defined by the deflector surface (19) and a lead edge (20) will provide surfaces upon which deposition can occur. If the size and dimensions of the surfaces (19), (20) are rendered sufficiently small it is understood that the deposition flakes which may become detached from the deflector (18) will generally be much smaller than the size and in particular diameter of the orifice or aperture (17) reducing the possibility of blockage of that aperture (17).

The deflector (18) also through its configuration and shape will also act as an obstacle in the flow (15). In such circumstances the obstacle created by the deflector (18) will act to promote break up of the laquer deposits which may become detached again increasing the probability of such broken up laquer deposits passing directly through the orifice or aperture (17) without initiating blockage.

It is understood that the deflector (18) in accordance with the aspects of the present invention is arranged to provide the above functions but generally the specific configuration and orientation of the deflector (18) will depend upon operational requirements. Potentially the deflector (18) should control the upstream flow (15*a*) such that the potential for build up of laquer deposits on the restrictor (14) is minimised or eliminated. Such idealised flow control may be achieved in some operating environments but in more aggressive environments, it is more likely that there will eventually be blockage of the restrictor (17) but over a longer period of time and at a reduced rate of deposition in the immediate vicinity of the restrictor.

Figure 4A:
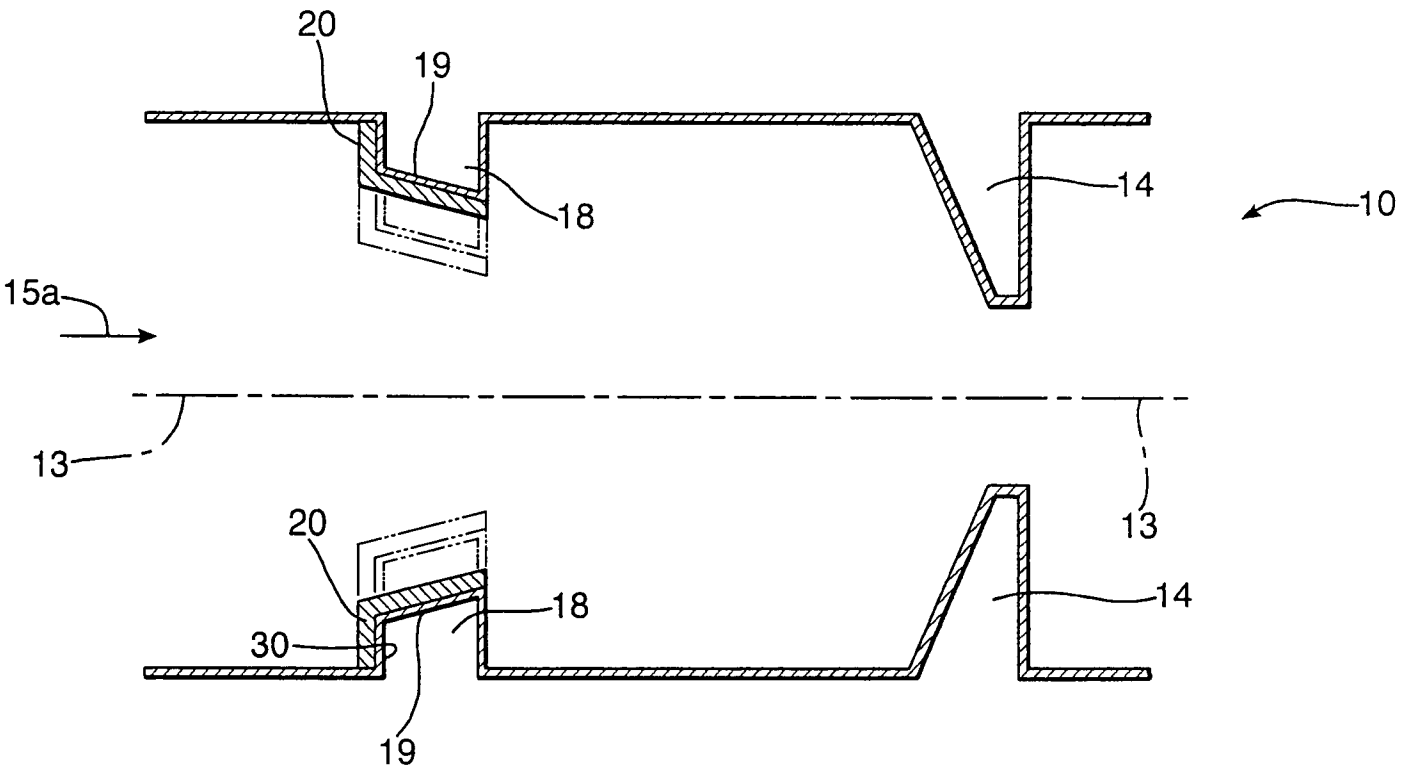
FIGS. 4A and 4B illustrate flow control arrangements in accordance with embodiments.

Generally, the deflector (18) will be a fixed component extending inwards of the flow path (12). However, it will be understood that the deflector (18) may be variably deployable across the flow path (12*a*) dependent upon current operational requirements. See FIG. 4A. In such circumstances, the deflector (18) will be presented upon an appropriate mechanical or electrical or hydraulic system. Such variable displacement of the deflector (18) may occur due to changes in the rate of flow of the fluid (15*a*) and/or the number of oil droplets which may create deposit laquers within the flow (15*a*) or changes in the environment of the arrangement (10) such as temperature, piping etc.

Figure 4B:
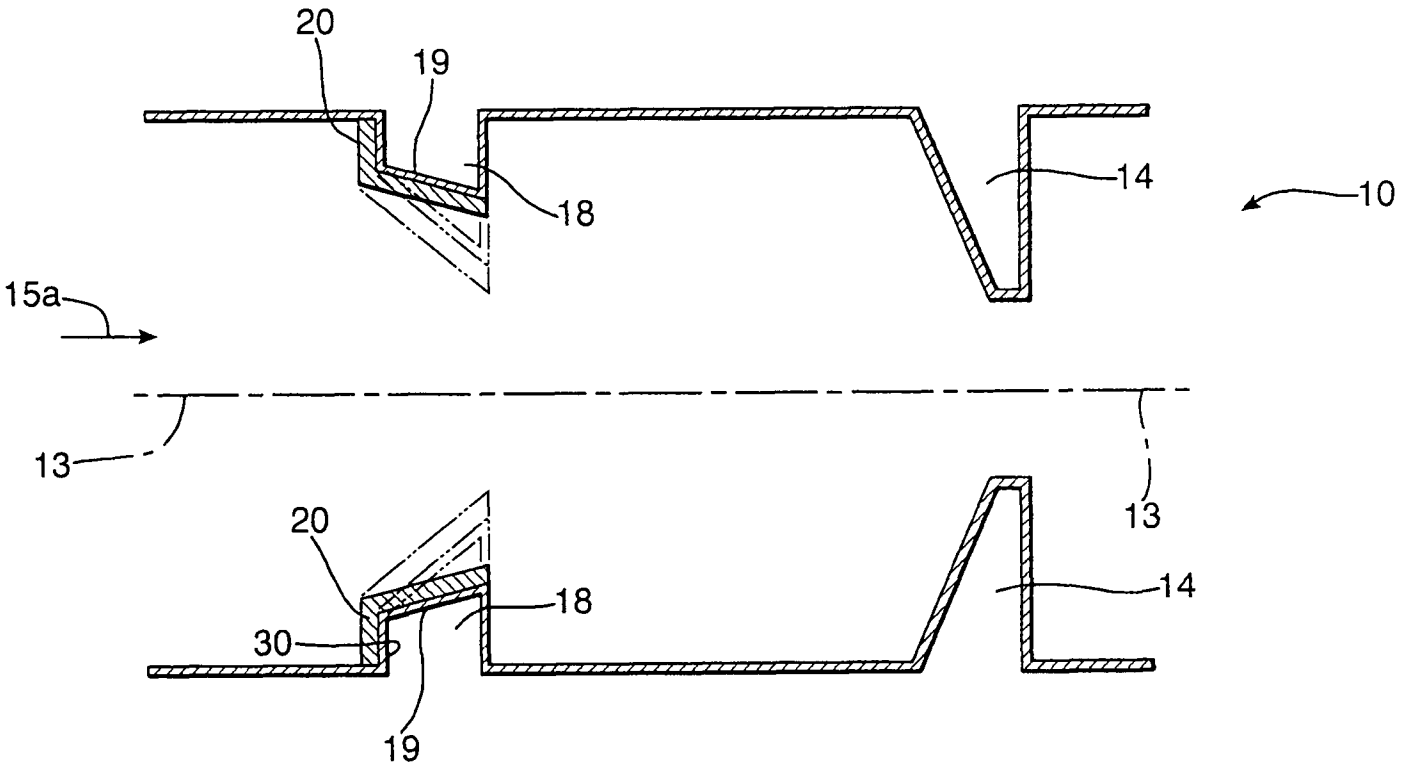

It is noted that the deflector (18) through the deflector surface (19) has an angular aspect. The deflector surface (19) is presented at a deflector angle to guide and deflect the flow (15) as indicated towards the orifice or aperture (17). The particular choice of deflector angle for the deflector surface (19) will depend upon operational requirements and the relative displacement (21) of the deflector (18) upstream of the restrictor (14). As indicated the objective of the deflector surface (19) and the deflector angle therefore is to present and guide the flow towards a position along the vent axis (13) which is upstream of the aperture or orifice (17) such that a greater proportion of the flow (15) passes directly through that orifice or aperture (17) rather than impinging upon parts of the restrictor (14) where deposition may occur. The angle of the deflector surface (19) may be altered (see FIG. 4B) with an appropriate mechanism and as required dependent upon operational conditions. Typically, the deflector surface (19) will be smooth in order to appropriately act upon the flow (15) for deflection towards the aperture or orifice (17). In some circumstances, it may be advantageous to provide an undulating or ribbed/grooved surface for the deflector surface (19).

It is understood that generally the deflector (18) extends for a width (22) of the flow path (12*a*). The width (22) will define the length of action by the deflector surface (19) upon the flow (15) and will be sufficient to have an effect on that flow (15). Generally, the width (22) will act as an inwardly projected component within the path (12*a*) and typically, the width (22) will be consistent for the deflected surface (19) throughout the periphery of the flow path (12*a*). However, the desirable width may vary where acceptable or desirable and furthermore in respect of the deflector surface (19) may be offset rather than directly opposite each other as depicted in FIG. 3.

As indicated above, generally the deposition surfaces compromising the deflector surface (19) and lead edge (20) will inevitably receive some laquer deposition from oil droplets in the flow (15*a*) where present. By appropriate sizing in terms of width and length in the surfaces of (19), (20) any lacquer fragments will be configured such that they are smaller than the width or size of the aperture or orifice (17). In such circumstances should flakes of deposition be shed from the surfaces (19), (20) these shed flakes will not be of a sufficient size to cause blockage of the aperture or orifice (17).

Aspects of the present invention provide for control such that laquer or deposition build up is inhibited but where such deposition occurs the flakes which may result from fragmentation will not cause aperture or orifice blockage. Essentially, the deposition process is avoided in the immediate vicinity of the restrictor (14). By such an approach the probability of deposition laquer shed from upstream surfaces causing problems will be greatly reduced. By the deflection of the flow (15) any transported deposits or potential oil droplets will be directed towards the open aperture of the orifice (17) rather than the flanks of the restrictor (14). By providing an obstacle effectively upstream of the orifice (17) and in particular the flow restrictor (14) the flow control arrangement in accordance with aspects of the present invention will promote break up of larger deposited laquer flakes as they are transported in the flow (15) by turbulence and potentially avoid merging with other flakes. It is also understood that the flakes when shed from the deflector (19) in accordance with the aspects of the present invention may have more momentum in the flow (15) and therefore tend to fragment during collision with parts of the restrictor (14) again reducing the size and potential for blocking of the aperture or orifice (17).

A further feature of the aspects of the present invention is provision of surfaces (19) and edge (20) which can be sacrificial with regard to deposition. As indicated particularly the leading edge (20) dimension can be configured to be much smaller than the diameter of the orifice or aperture (17). In such circumstances any flakes of deposition laquer on the surface of the edge (20) as indicated will generally be much smaller than the orifice (17) and therefore will pass through it unhindered.

A further feature of the aspects of the present invention is provision within the arrangement of a region of increased velocity immediately upstream of the orifice or aperture (17). Such increased velocity will again reduce the potential for deposition within the vicinity of the orifice (17) and in particular on the flanks of the flow restrictor (14).

As indicated above deflection in accordance with aspects of the present invention will significantly affect operational functionality. In such circumstances as indicated the deflector may be variably deployable. Alternatively, deflectors of different size or dimensions may be located as collets within a conduit forming the flow path. In such circumstances a collet with an appropriate deflector configuration for necessary operational performance may be located in the flow path as required. Furthermore, such collets incorporating a deflector located within the flow path may be removed to allow and utilise the sacrificial nature of certain surfaces of the deflector in terms of allowing deposit build up. Thus, once a deflector in terms of deposition has reached a certain level of deposition it may be replaced with a fresh deflector and so remove the possibility of flaking of the deposits causing problems downstream.

The deflector (18) in accordance with aspects of the present invention in particular with regard to the lead edge surface (20) has a dimension which is much smaller than the orifice (17) whilst a converging chamfer or radius is provided as the deflector surface (19) to direct the flow (15) including any oil deposits and other free particles towards the vent axis (13) through the orifice in order to maximise the probability that such particles and oil droplets will pass directly through the orifice or aperture (17) rather than impinge upon the flank surfaces of the restrictor (14).

By optimising the distance between the deflector (18) and the restrictor (14) it is understood that consideration could be made as to the expected size and density of particular matter such as oil droplets or guiding towards the orifice or aperture (17). Generally, the displacement distance (21) will be in the order of 4-6 times the orifice (17) diameter.

Generally, as indicated, the deflector surface (19) will have a smooth finish in order to inhibit deposition and delay lacquer build up. However, alternatively, surfaces of the deflector (18) may be treated with an appropriate coating such as PTFE or similar in order again to inhibit lacquer and deposition build up or preferentially cause such deposition.

Although described principally with regard to flow typically utilised within sealing arrangement of gas turbine engines it is understood that flow control arrangements in accordance with aspects of the present invention may be utilised in a range of engineering and other processing or other mechanisms.

By aspects of the present invention the potential to reduce unwanted deposition of particles and oil droplets upon restrictor surfaces is achieved. Furthermore, by provision of sacrificial deposit surfaces it is understood that any deposition can be proportionately directed towards insensitive parts of the arrangement rather than the flow restrictor aperture or orifice. Thus, aspects of the present invention may also be utilised with regard to high velocity particle transport systems in which erosion rather than deposition are undesirable features of operation. In such embodiments it is envisaged that in addition to applying treatment to facilitate flow control and restriction further treatments may also be utilised with respect to promoting wear resistance such as surface hardening.

Aspects of the present invention may be utilised with regard to continuous flow phase operations with regard to a gas such as sealing air but it is also envisaged that other gases, liquids or pulverised/fluidised solids may be controlled in accordance with arrangements of aspects of the present invention. Furthermore, there may be dispersed phases of one fluid such as a gas (bubbles) or liquid (droplets) or solid particles within a flow controlled in accordance with arrangements of aspects of the present invention.

Further aspects of the present invention it will be appreciated by persons skilled in the technology. Thus for example generally the deflector will be formed from relatively robust materials to remain stable in use. However alternatively resilient and deflectable materials may be used which may bend and alter in shape to reduce the deflection surface in particular of a deflector in accordance with aspects of the present invention to alter the operational effective deflection length presented to a fluid flow or air flow in use.

The invention claimed is:

1. A flow control arrangement comprising:

a flow path, a flow restrictor in the flow path of reduced area relative to the flow path, a deflector provided upstream of the flow restrictor in the flow path at a displaced position and orientated towards the restrictor, and a sealing arrangement upstream of the deflector and configured to provide a fluid flow comprising solid or fluid particles entrained in a gas, wherein the deflector comprises at least one deposition surface having a width less than a width of the reduced area of the flow restrictor, the deflector is displaced upstream of the restrictor between four and six times the width of the reduced area of the flow restrictor, the deflection surface includes a sacrificial deposition area for deposits taken from the flow, and the deposition area is arranged to limit deposition particle sizes upon fragmentation from the deposition area.

2. An arrangement as claimed in claim 1 wherein the deflector has a deflector surface at a deflection angle towards a position upstream of the restrictor.

3. An arrangement as claimed in claim 2 wherein the position is along a vent axis central to the flow path and/or the restrictor.

4. An arrangement as claimed in claim 2 wherein the deflection angle is dependent upon an expected flow rate for the flow in use.

5. An arrangement as claimed in claim 2 wherein the deflection angle can be adjusted.

6. An arrangement as claimed in claim 1 wherein the deflection surface has a width sufficient to deflect the flow in use.

7. An arrangement as claimed in claim 1 wherein the deflection surface is smooth.

8. An arrangement as claimed in claim 1 wherein the deflection surface is undulated or grooved.

9. An arrangement as claimed in claim 1 wherein the deposition area has a width less than the restrictor size.

10. An arrangement as claimed in claim 1 wherein the deflection surface includes a coating to inhibit deposition.

11. An arrangement as claimed in claim 1 wherein the deflector is variably deployable into the flow path.

12. An arrangement as claimed in claim 1 wherein the flow in use is air with entrained oil droplets.

13. An arrangement as claimed in claim 1 wherein the flow in use is air with entrained particulate matter, where deposition and build is possible.

14. An arrangement as claimed in claim 1 wherein the flow deflection feature is hardened or otherwise treated to sacrificially resist erosion.

15. An arrangement as claimed in claim 1 wherein the restrictor is an orifice.

16. A gas turbine engine incorporating a flow control arrangement as claimed in claim 1.

* * * * *